United States Patent [19]

Tanino et al.

[11] 4,086,107

[45] Apr. 25, 1978

[54] HEAT TREATMENT PROCESS OF HIGH-CARBON CHROMIUM-NICKEL HEAT-RESISTANT STAINLESS STEELS

[75] Inventors: Mitsuru Tanino, Tokyo; Hajime Komatsu, Kawasaki; Susumu Takemura, Hikari, all of Japan

[73] Assignee: Nippon Steel Corporation, Tokyo, Japan

[21] Appl. No.: 764,846

[22] Filed: Feb. 2, 1977

Related U.S. Application Data

[63] Continuation-in-part of Ser. No. 578,268, May 16, 1975, abandoned.

[30] Foreign Application Priority Data

May 22, 1974 Japan ..... 49-56634

[51] Int. Cl.[2] ..... C21D 4/00

[52] U.S. Cl. ..... 148/136; 148/12 E; 148/38; 75/128 R

[58] Field of Search ..... 148/134, 135, 136, 137, 148/3-16, 37, 38, 12 R, 12 E; 75/126 A, 126 B, 126 P, 126 Q, 126 R, 128 A, 128 C, 128 F, 128 R

[56] References Cited

U.S. PATENT DOCUMENTS

| | | | |
|---|---|---|---|
| 3,235,417 | 2/1966 | Roy et al. | 148/136 |
| 3,459,539 | 8/1969 | Eiselstein et al. | 75/128 R |
| 3,762,913 | 10/1973 | Boyko et al. | 75/128 R |
| 3,826,689 | 7/1974 | Ohta et al. | 148/3 |
| 3,865,581 | 2/1975 | Sekino et al. | 75/128 R |
| 3,871,928 | 3/1975 | Smith et al. | 148/136 |

*Primary Examiner*—Walter R. Satterfield
*Attorney, Agent, or Firm*—Toren, McGeady and Stanger

[57] ABSTRACT

The present invention relates to a heat treatment process of high-carbon chromium-nickel heat-resistant stainless steels for the purpose of improving the creep rupture strength of the steel at temperatures over about 800° C particularly at about 1000° C.

The feature of the present invention lies in that heat-resistant stainless steels containing 0.2 - 1.5% C, 15 - 40% Cr, 10 - 50% Ni, 5% or less Si, 15% or less Mn, with the balance Fe, and impurities are heated for 1 to 60 minutes in a temperature range from 1280° C to 1350° C and then quenched to room temperature at cooling rates higher than 200° C/min. in order to produce the eutectic carbide structure consisted of the matrix metal and carbide phases in which $M_7C_3$-type carbide is contained not less than 25% by weight of the total weight of the carbides, that are present in the said eutectic carbide structure, at grain boundary triple points, along grain boundaries and within grains.

2 Claims, 9 Drawing Figures

AS HOT-EXTRUDED X200

1300°C, 1 HR. W.Q. X500

1290°C, 3 HR. W.Q. X200

1320°C, 5 MIN. W.Q. X200

1300°C, 1 MIN. W.Q. X500

HEAT TREATMENT PROCESS OF HIGH-CARBON CHROMIUM-NICKEL HEAT-RESISTANT STAINLESS STEELS

CROSS REFERENCE TO RELATED APPLICATION:

This application is a continuation-in-part of our copending application Ser. No. 578,268 filed on May 16, 1975, and now abandoned.

BACKGROUND OF THE INVENTION

High-carbon chromium-nickel heat-resistant stainless steels are excellent in mechanical properties and oxidation resistance at high temperature over 800° C and are widely used in high-temperature chemical engineering equipments. However, such steels generally have only limited workability, and therefore the tubular products of such steels are generally manufactured by centrifugal casting methods. The tubular products manufactured by the centrifugal casting methods have an unsound inner surface including casting defects, and the dimensional accuracy is low. The size of the products is also restricted.

The tubular or plate products of such steels may be manufactured in other ways. For instance, they can be manufactured by the usual hot working or hot- and cold-working processes such as extrusion and rolling from blooms made by the usual blooming processes. The products made by such processes are not as restricted in the shape and size as those made by the centrifugal casting methods. The impermissible drawback of the products made by such processes is that the high temperature creep rupture strength is markedly decreased as compared with the centrifugally cast products.

The reason is that, the carbide phase within the products manufactured by the usual hot working or hot- and cold-working exists as coarse $M_{23}C_6$-type carbide particles before use and the carbide becomes coarser during service at temperature over 800° C, resulting in considerably low level of creep rupture strength at these temperatures.

A number of attempts have been made to improve the creep rupture strength of the products of high-carbon chromium-nickel stainless steels manufactured by usual hot- and cold-working. However, it has been well known that the creep rupture strength can be improved only to a small extent by a heat treatment process in which the said products are subjected to solution treatment and subsequent aging.

There is an alternative heat treating process to improve the creep rupture strength of hot- and cold-worked products of high-carbon chromium-nickel stainless steels by giving a microstructure where a continuous carbide precipitation is present along the grain boundaries by applying the said heat treating process, in which the said products are heated to a temperature range between 1150° C to the solidus line with subsequent slow cooling to 950° C or higher over a period of from 5 sec. to 1 hour and thereafter rapid cooling. By applying such heat treatment the creep rupture strength of wrought high-carbon chromium-nickel stainless steels are said to be increased at elevated temperatures where grain boundary sliding is a dominant factor controlling the creep rupture strength of the said steels, because grain boundaries are strengthened by continuous precipitation of $M_{23}C_6$-type carbide. However, this heat treating process has some difficulties from the practical standpoint of view. For example, it will take a rather long period probably not less than 60 min., because it is well known that rows of coarse particles of $M_{23}C_6$-type carbide can not readily be redissolved in a short time at a temperature below about 1300° C.

SUMMARY OF THE INVENTION

The object of the present invention is to provide a heat treatment process which improves the creep rupture strength of tubular or plate products of high-carbon chromium-nickel heat-resistant stainless steels manufactured by the usual hot working or hot- and cold-working to the extent comparable to or superior to those of the centrifugally cast products with similar chemical compositions, by giving the said products "the eutectic $M_7C_3$ structure", which is consisted of the matrix metal constituent and the carbide constituent in which $M_7C_3$-type carbide is contained not less than 25% by weight of the total weight of carbides present.

The tubular or plate products of high-carbon chromium-nickel heat-resistant stainless steel manufactured by the usual hot working or hot- and cold-working are heated for 1 to 60 minutes in a temperature range from 1280° C to 1350° C and then quenched to room temperature at cooling rates higher than 200° C/min. in order to produce the eutectic carbide structure consisted of the matrix metal and carbide phases in which $MTC_3$-type carbide is contained not less than 25% by weight of the total weight of the carbides, that are present in the said eutectic carbide structure, at grain boundary triple points, along grain boundaries, and within grains. This process is based on the present inventors' findings that the creep rupture strength of such steels is significantly affected by the types and morphology of the carbide existing in the structures, and markedly improved to the extent comparable to or superior to those of the centrifugally cast products by providing the said eutectic carbide structure by the said heat treatment above.

Although the temperature range and cooling procedure included in the present invention seem to be similar to those of previously known heat treatment processes, the metallurgical significance of the heat treatment process according to the present invention is quite novel and unique, because the essential point of the present process is to increase the creep rupture strength of wrought products of high-carbon chromium-nickel stainless steels by giving the said products "the eutectic $M_7C_3$ structure", which has been considered as detrimental and to be avoided to form in the previous arts of heat treatments.

DETAILED DESCRIPTION OF THE INVENTION

Figure 1:
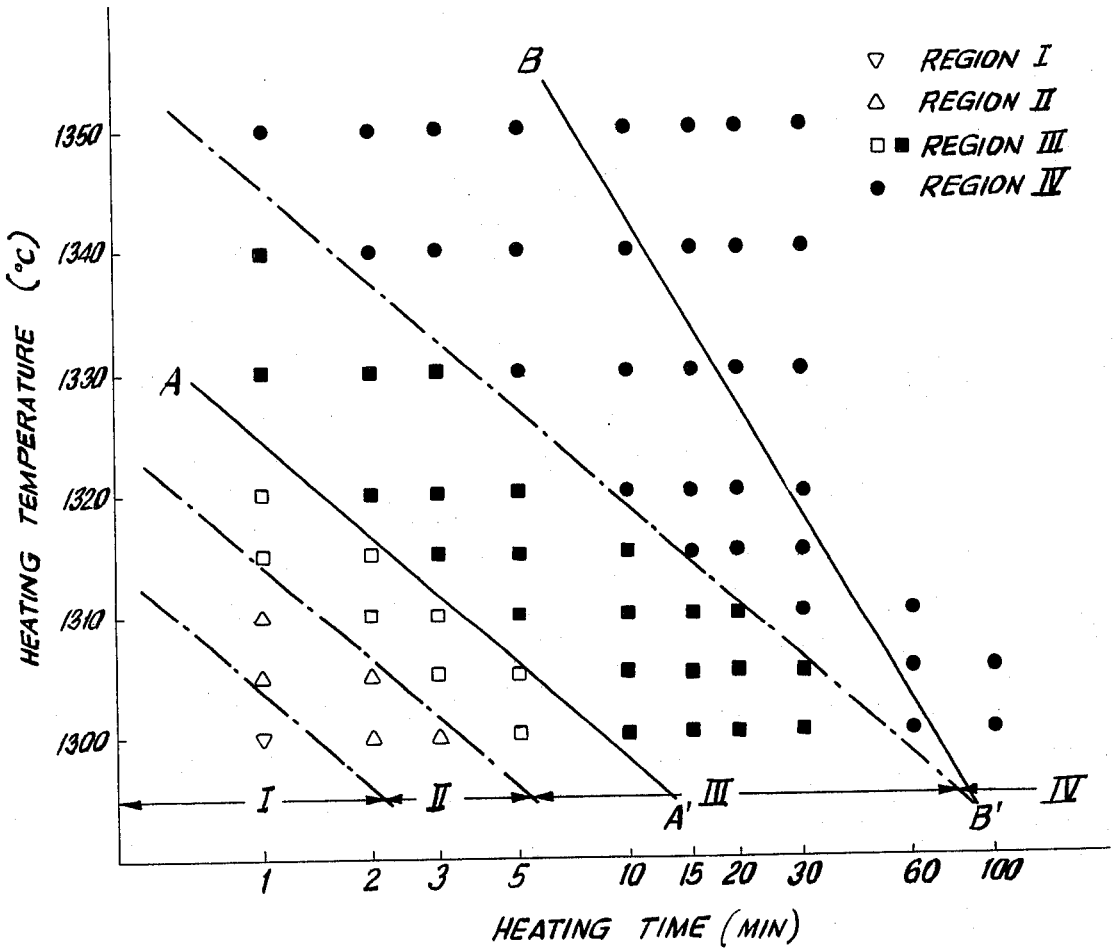
FIG. 1 is a phase diagram indicating the types and the fractions of the carbides which are present in the said eutectic carbide structure produced when a high-carbon chromium-nickel, heat-resistant stainless steel comprised of 0.4% C, 25% Cr, 20% Ni, 1% Si, 1.5% Mn, and the remainder essentially iron and impurities is heated for 1 to 60 minutes in a temperature range from 1300° to 1350° C.

The present invention provides a heat treatment process for improving creep rupture strength of high-carbon chromium-nickel stainless steels at temperatures over about 800° C particularly at about 1000° C, by producing the eutectic carbide structure consisted of the matrix metal and carbide phases in which $M_7C_3$-type carbide is contained not less than 25% by weight of the total weight of the carbides, that are present in the said eutectic carbide structure at grain boundary triple points, along grain boundaries, and within grains.

Cast high-carbon chromium-nickel stainless steels such as HK 40 have been widely used as a material for the equipments for high temperature chemical engineering such as an ethylene theremal cracking furnace or a steam reformer because their mechanicl properties and oxidation resistance are excellent at high temperatures over about 800° C. The application of such cast steels to the multi-purpose high temperature gas-cooled reactor is also under consideration. Such high-carbon chromium-nickel stainless steels have only limited workability and, accordingly, the centrifugal casting method is generally employed for the manufacture of tubular products. Even though such tubular steel castings are obtained by the centrifugal casting method, the products have still other disadvantages such as unsound inner surfaces including casting defects or low accuracy in dimension of the products. The centrifugal casting method can produce tubular products only limitedly in size (diameter, thickness and length of tubular products), and can not produce long tubular products of small diameter and thin wall. Such difficulties have not yet been overcome.

On the other hand, tubular or plate products with the similar chemical compositions can also be manufactured from blooms, which are made by usual blooming processes by the usual hot working or hot- and cold-working processes (for example, extrusion and/or rolling); and in this case, tubular or plate products with a wider range of shapes and sizes can be produced as compared with those obtained by the centrifugal casting method. However, a serious drawback of this process is that the high temperature creep rupture strength, which is the most important characteristics of heat resistant materials, of the tubular or plate products manufactured by such hot working or hot- and cold-working processes is markedly low as compared with the centrifugally cast products.

The reason is that when the products are manufactured by hot working or hot- and cold-working, coarse carbide particles of $M_{23}C_6$-type already exist before use, and such coarse carbide particles grow progressively during service at temperatures over about 800° C.

The principal purpose of the present invention is, by applying a novel and unique heat treatment process according to the present invention, to increase the creep rupture strength of the tubular or plate products of high-carbon chromium-nickel heat resistant steels manufactured by the usual hot working or hot- and cold-working to the extent comparable to or superior to those of the centrifugally cast products.

In other words, the present invention provides a heat treatment process for imparting creep rupture strength comparable to or superior to those of the centrifugally cast products to the tubular or plate products of high-carbon chromium-nickel heat-resistant stainless steels manufactured by hot working or hot- and cold-working, by producing the eutectic carbide structure consisted of the matrix metal and carbide phases in which $M_7C_3$-type carbide is contained not less than 25% by weight of the total weight of the carbides, that are present in the said eutectic carbide structure, at grain boundary triple points, along grain boundaries, and within grains (hereinafter referred to as an eutectic $M_7C_3$structure) by heating the said steels for 1 to 60 minutes in a temperature range from 1280° C to 1350° C.

The present inventors have carried out extensive experiments to study the effects of heat-treating conditions on the high temperature creep rupture strength of products manufactured by the usual hot working or hot- and cold-working, from blooms with the similar chemical compositions as those of high-carbon chromium-nickel heat-resistant cast steels. According to the results o these studies, it is found that important factors affecting the creep rupture strength of high-carbon chromium-nickel heat-resistant stainless steels are the types, morphology, distributions, and quantity of carbide phases, the types and morphology being especially important. For example, it is found that, even if the chemical composition of the steel is same, the highest level of creep rupture strength is obtained when the eutectic carbide structure consisted of the matrix metal and carbide phases in which $M_7C_3$-type carbide is contained not less than 25%, preferably more than 50% by weight of the total weight of the carbides ($M_7C_3$ + $M_{23}C_6$), that are present in the said eutectic carbide structure, at grain boundary triple points, along grain boundaries and within grains ("the eutectic $M_7C_3$ structure").

The carbide phases which are formed in high-C-Cr-Ni heat resistant stainless steels consisting of 0.2–1.5% C, 15–40% Cr, 10–50% Ni, 5% or less Si, 15% or less Mn, 0.01% or less B, and the balance Fe and impurities is found to be of $M_{23}C_6$-type carbide and $M_7C_3$-type carbide. In order to evaluate the metallurgical aspect of the invented steels, the present inventors have conducted extensive experiments with different heat treatment temperatures and times along with the respective quenching steps subsequent to the heat treatment, — the metallurigical meaning of the quench step will be described later —, and have drawn a conclusion, that the metallurgical aspect depends on the composition of the carbide phase. This composition has been analyzed in weight percentages of $M_7C_3$ or $M_{23}C_6$ carbide based on the total weight of all the carbides, and the thus obtained numerical data are shown in the specification and claims of our invention. As all the possible forms of carbides in the said steels are $M_7C_3$ and $M_{23}C_6$ alone, the sum of the percentages of $M_7C_3$ and $M_{23}C_6$ is always 100%. In other words, the representation of 25% $M_7C_3$ indicates that a 25% by weight fraction of all the carbides which are present in the material of the steel constitutes $M_7C_3$ and a 75% by weight fraction of all the carbides constitutes $M_{23}C_6$. With the help of a formula, 25% $M_7C_3$ may be expressed as $(M_7C_3)/(M_7C_3 + M_{23}C_6) \times 100 = 25$ (% by weight). As has already mentioned above, in the heat treatment process according to the present invention, these types of carbides appear as an eutectic structure. Even in this case, by 25% $M_7C_3$ value herein used, it is meant that $M_7C_3$ carbide occupies 25% by weight of the sum of the carbide constituents from which the eutectic structure is made up. Accidental introduction of Nb, Ta or Ti in a very small amount as an impurity gives rise to some possibility of forming a small amount of MC-type carbide. Even if it is formed, the weight of the MC-type carbide is negligibly small as compared with the weight of $M_{23}C_6$ and/or $M_7C_3$ carbide so that the above identified compositional ranges may be left substantially unchanged. $M_6C$-type carbide may form only when Mo and/or W is present in a comparatively large amount, and, therefore, may be considered as almost impossible to form in the steels relevant to the present invention, because the percentage of Mo and/or W is very low if present as impurities. It is further to be noted that although Al serves as an important element for forming the gamma-prime phase (intermetallic compound), it is not a carbide former, causing no Al carbide to be formed in the steel. Thus, the presence of a small amount of Al as a deoxidizer has no effect on the weight percentage of $M_7C_3$-type carbide.

FIG. 1 shows the types and the weight fractions of the carbides which are present when a hot-extruded material of a high-carbon chromium-nickel heat-resistant stainless steel containing 0.4% C, 24% Cr, 20% Ni, 1% Si and 1.5% Mn is heated with various conditions ranging for 1 to 60 minutes in a temperature range from 1300° to 1350° C. The region I is a region where the carbide phase is 100% $M_{23}C_6$-type carbide; the region II is a region where $M_{23}C_6$-type carbide coexists with $M_7C_3$-type carbide but the weight fraction of the latter carbide is less than 25% of the total carbides present; in the region III both carbides also coexist but the weight fraction of $M_7C_3$-type carbide is more than 25% and less than 100%; and the region IV indicates a region where all the carbide phase is of $M_7C_3$-type.

The object of the heat treatment process according to the present invention is to improve the creep rupture strength of high-carbon chromium nickel heat-resistant stainless steels manufactured by the usual hot working or hot- and cold-working by producing the eutectic carbide structures in which at least 25% preferably 50% or more $M_7C_3$-type carbide is present by selecting the heating temperature and time in the range of the regions III and IV.

FIG. 2 illustrates the micro-structures of a material of the same composition as described in FIG. 1, which was heated to various times and temperatures and then quenched into water.

The range of heating temperature in the heat treatment process according to the present invention should be from the temperature at which the formation of the eutectic $M_7C_3$ structure begins to occur to the solidus temperature of the steels. In the case of a steel containing 0.4% carbon, 24% chromium, 20% nickel, 1% silicon, and 1.5% Mn, the lowest temperature limit is 1300° C. The reason is that, in case the heating temperature is below 1300° C, rows of coarse granular $M_{23}C_6$-type carbide particles which are produced during hot extrusion can neither be completely redissolved even after a long period, nor an eutectic carbide structure is formed.

Figure 2A:
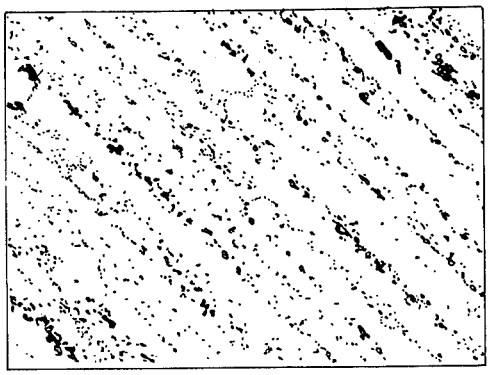
FIG. 2 (a through e) shows the microstructure of the same steel as hot-extruded and after heat treatment under various conditions.
Figure 2D:
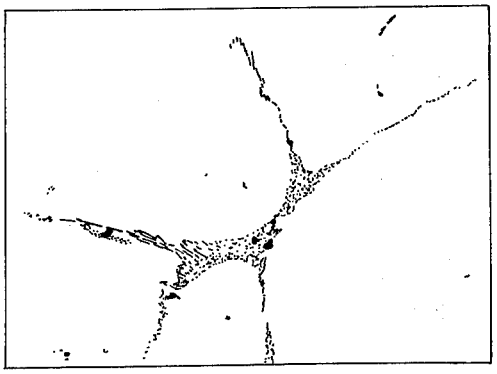
Figure 2B:
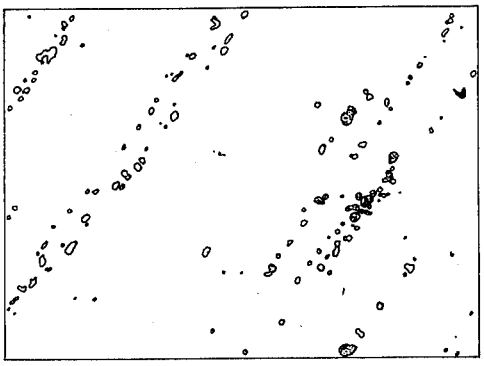

FIG. 2(a) shows the micro-structure of an as hot-extruded material; FIG. 2(b) shows the mirco-structure of a hot-extruded material after heat-treated at 1290° C for3 hours and then quenched into water. It is evident in either case that rows of coarse granular carbide particles of $M_{23}C_6$-type are present. These coarse granular carbides of $M_{23}C_6$-type are very stable and hardly decomposed or dissolved in a temperature range below 1300° C. The material having only these coarse granular carbide particles of $M_{23}C_6$-type distributed in the structure is markedly low in the creep rupture strength and can not be placed into practical use as shown later in Table 1.

Figure 2E:
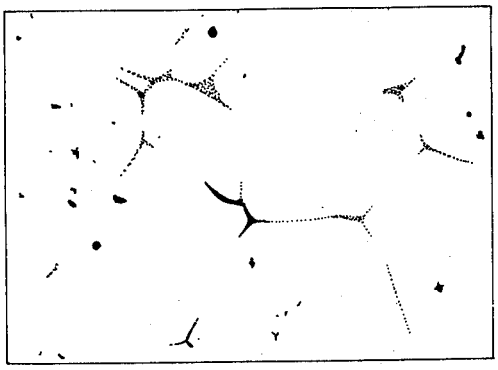
Figure 2C:
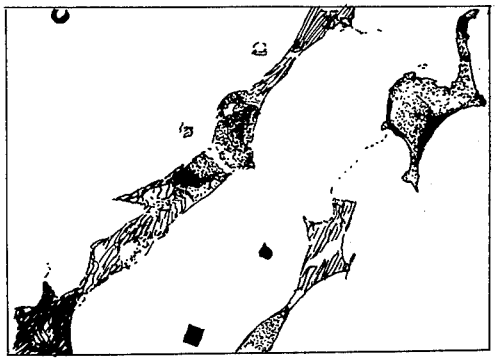

When the same material is heated at temperatures above 1300° C, however, the coarse granular $M_{23}C_6$-type carbide particles as shown in FIG. 2(b) are rapidly dissolved into solid solution in a short time, and in place an eutectic structure consisted of carbides and the matrix metal is developed. For instance, FIG. 2(c) shows an example of the micro-structure of the said material quenched into water after heating at 1300° C for 1 minute, where an eutectic structure consisted of $M_{23}C_6$-type carbide and the matrix metal is formed, corresponding to the condition of the region I of FIG. 1. With the increase of heating time at 1300° C, the carbide gradually transforms from $M_{23}C_6$-type to $M_7C_3$-type, and after one hour heating, an eutectic structure consisted of $M_7C_3$-type carbide and the matrix metal (the region IV of FIG. 1) is formed at shown in FIG. 2(d). FIG. 2(e) shows the micro-structure of the said material quenched into water after heating at 1320° C for 5 minutes. In this case, both $M_{23}C_6$-type and $M_7C_3$-type carbides coexist within the eutectic structure corresponding to the region III where the weight fraction of $M_7C_3$-type carbide exceeds 25%. The higher the temperature, the quicker the change from the region I to the region IV is.

The creep rupture strength at high temperatures, for instance, at 1000° C is fairly increased as compared with hot-extruded condition by giving an eutectic carbide-structure corresponding to the region I, but it is still inferior to the creep rupture strength of the centrifugally cast material. As the structure changes from the region II to the regions III and IV, the creep rupture strength increases gradually, and reaches such strength level as comparable to or superior to that of the centrifugally cast material when the eutectic carbide structures belonging to the regions III and IV are formed.

Figure 3:
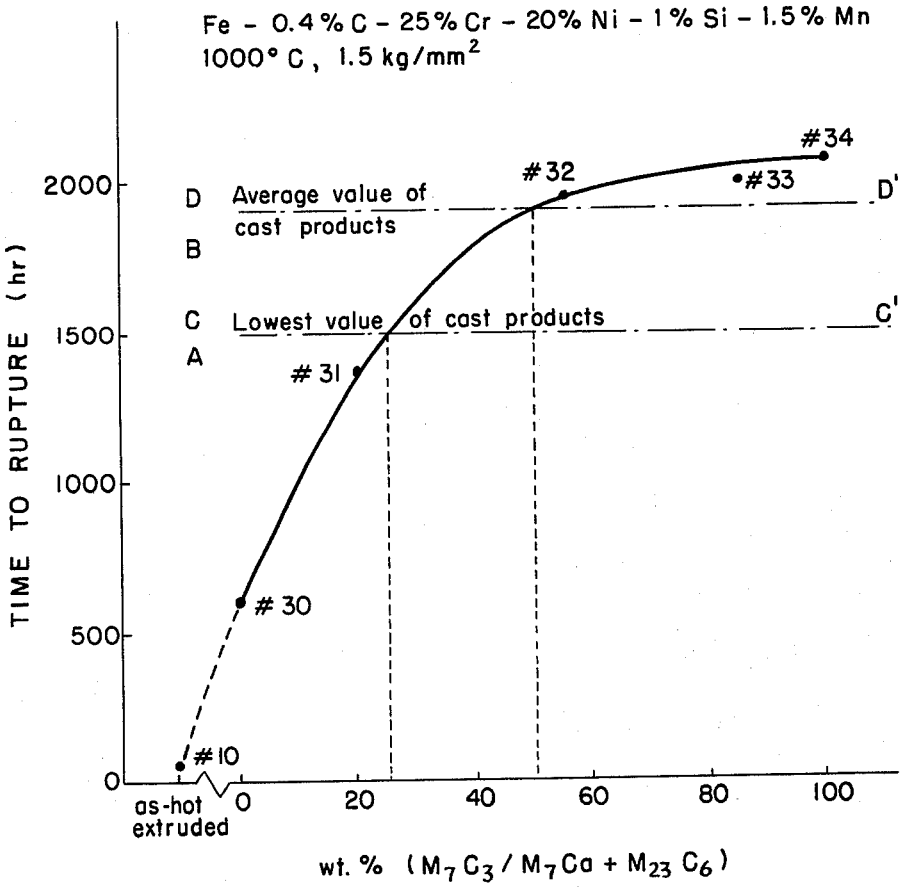
FIG. 3 shows the relation between the creep rupture life at 1000° C, 1.5 kg/mm$^2$ and the carbide composition of the eutectic carbide structure in a steel containing 0.4% C, 25% Cr, 20% Ni, 1% Si, 1.5% Mn, and the remainder Fe and impurities.

We have defined the compositional range of $M_7C_3$ as more than 25% and, preferably, 50% on the basis of the following facts. The specification of the present application provides Table 1 for a high-C-Cr-Ni heat resistant stainless steel consisting of 0.4% C, 25% Cr, 20% Ni, 1% Si, 1.5% Mn, the balance being Fe and impurities to illustrate how much effective our heat treatment is for improving the creep rupture time at 1000° C by comparison with the as-hot extruded condition. Using these numerical data, a curve is drawn as shown in FIG. 3 by plotting the time to rupture (rupture life) in ordinate against weight fraction of $M_7C_3$ (%) in abscissa. As is evident from this graph, the rupture life is increased with increase of the weight fraction of $M_7C_3$, reaching the maximum at 100% $M_7C_3$. In FIG. 3, there are given two horizontal dot-and-dash lines, with the line CC' indicating a possible lower limit of the creep rupture properties of large numbers of as-cast steels having 0.4% C, 25% Cr and 20% Ni (HK-40), of which the data source is: B. Estrich "Material Technology in Steam Reforming Process" (1966), Pergamon Press in p. 42. Therefore, it is possible to impart the hot-worked or hot- and cold-worked 0.4% C - 25% Cr - 20% Ni steel the creep rupture properties comparable to that of as-cast HK-40 provided that at least 25% of $M_7C_3$ (by weight) is formed as the carbide constituent in the eutectic carbide structure by subjecting to the heat treatment process according to the present invention. This is the reason for determining the lower limit of the compositional range of $M_7C_3$ as 25%, though the creep rupture properties at 25% $M_7C_3$ are found as marginally acceptable even with the as-cast HK-40s.

In addition to the line CC', there is drawn a line DD' for the rupture life of Sample No. 60 of Table 1, which show average creep rupture properties among large numbers of as-cast HK-40s. As the line DD' intersects the creep rupture curve at a point near 50% $M_7C_3$, it is required that the amount of $M_7C_3$ within the eutectic carbide structure in the steel be more than about 50% by weight in order to obtain creep rupture properties comparable to or superior to the average value of as-cast HK-40s, or otherwise our invention can not achieve the improvement of the rupture life over that of the average as-cast HK-40. In other words, in order to insure that our heat treatment process provides as high a creep rupture strength as that of the commonly available as-cast HK-40, it is preferable to increase the amount of $M_7C_3$ within the eutectic carbide structure up to more than 50% by weight. This is the reason for limitation of $M_7C_3$ content.

The reason for such great improvement in the creep rupture strength is considered as follows. In high-carbon chromium-nickel heat-resistant stainless steels which were subjected to the heat treatment according to the present invention, $M_7C_3$-type carbide is contained not less than 25% by weight of the total weight of carbides (i.e. $M_7C_3 + M_{23}C_6$), as the carbide-constituent in the eutectic carbide structure, at grain boundary triple points, along grain boundaries, and within grains. During service at high temperatures, the $M_7C_3$-type carbide transforms into $M_{23}C_6$-type carbide and then released carbon atoms re-precipitate as new fine carbide particles of $M_{23}C_6$-type mainly along grain boundaries, resulting in increased creep rupture strength.

The eutectic carbide structure is mainly formed at grain boundary triple points and along grain boundaries. Occasionally, it is also formed within matrix around coarse particles of non-metallic inclusions. According to the experimental results of the present inventors, however, the creep rupture strength of the steels which were subjected to the heat treatment process of the present invention, does not significantly depend on the distribution of the eutectic carbide structure, but depends mainly upon the weight fraction of $M_7C_3$-type carbide within the said eutectic carbide structure.

Thus in order to improve the creep rupture strength of the high-carbon chromium-nickel stainless steels by the heat treatment process according to the present invention, the material should be brought to have the eutectic carbide structure corresponding to the regions III and IV. In other words, the said material should contain $M_7C_3$-type carbide at least 25%, preferably more than 50% by weight of the total weight of carbides, as the carbide constituent in the eutectic carbide structure. However, from the practical stand point of view, the heat treatments for excessively long time or at excessively high temperature should be avoided in order to prevent excessive oxide scale formation as well as reduction in productivity.

From the aforesaid reasons, the most preferable heat treatment condition according to the present invention for a steel containing 0.4% carbon, about 24% chromium, about 20% nickel, 1% silicon, and 1.5% manganese should be chosen within the region bounded by the two straight lines AA' and BB' of FIG. 1. The straight line AA' represents the lower limit of the heat treating condition in which the weight fraction of $M_7C_3$-type carbide to the total weight of the carbides present in the said eutectic carbide structure is 50% or more, and the straight line BB' represents the upper limit of the heat treating condition from the view-point of oxide scale formation, productivity, etc.

It is herein added that the application of the heat treatment process according to the present invention is not limited to a high-carbon chromium-nickel heat resistant steel containing 0.4% C, 25% Cr, 20% Ni, 1% Si and 1.5% Mn with the balance essentially iron and impurities. As the results of extensive experimental studies conducted by the present inventors, the heat treatment process of the present invention is applicable to a wide range of high-carbon chromium-nickel heat resistant steels with chemical compositions of 0.2 - 1.5% C, 15 - 40% Cr, 10 - 50% Ni, Mn not more than 15%, boron not more than 0.01%, the balance being iron and impurities.

The reasons for defining the content of the compositional elements are described in the following:

The higher the carbon content, the greater the quantity of produced eutectic carbide structure is. However, when the carbon content exceeds 1.5%, it becomes markedly difficult to redissolve rows of coarse granular $M_{23}C_6$-type carbide particles remaining after the usual hot working or hot- and cold-working, and the workability during hot- and cold-rolling is also lowered. Hence, the upper limit of carbon content is set to 1.5%. In case carbon content is less than 0.2%, sufficient creep rupture strength is not obtainable since the eutectic carbide structure, a feature of the heat treating process according to the present invention is not formed. Hence, the lower limit of carbon content is set to 0.2%. Further, the carbon content is preferably 0.3 - 1.0% for obtaining sufficient creep rupture strength and good hot- and cold-workability Chromium is an element necessary for increasing oxidation resistance at high temperatures and required at least 15% or more. However, if the chromium content is too high, the workability is affected adversely and the ductility loss after use for a long time is enhanced. The upper limit of chromium content is accordingly set to 40%.

Nickel is an austenite stabilizing element and facilitates the formation of the eutectic $M_7C_3$ structure. However, in case the nickel content is less than 10%, sufficient creep rupture strength is not obtainable at high temperatures. Moreover, when the nickel content exceeds 50%, the creep rupture strength does not increase much, although the cost is much increased. Thus the merit is not deserving. The range of nickel is hence limited to 10 - 50%.

Silicon, which is added for deoxidation of steel, improves the oxidation resistance at high temperatures. Silicon remarkably increases the creep rupture strength since it facilitates the formation of the eutectic $M_7C_3$ structure. However, in case the content is more than 5%, the workability and weldability are deteriorated. Hence the upper limit is set to 5%.

Manganese is added for deoxidation and the prevention of hot brittleness. It has a strong effect for stabilizing austenite and can be accordingly used as a substitute element for expensive nickel. However, in case manganese content is too high, the oxidation resistance is deteriorated and hence the content is limited to 15% or less.

Boron is an element which is added if necessary. It is effective in making carbide precipitates fine and stable, the facilitates the formation of the eutectic $M_7C_3$ structure resulting in improved creep rupture strength. Boron content is excess of 0.01% deteriorates the hot-workability and weldability. Accordingly, boron content is limited to 0.01% or less.

As described above, the heat treatment process according to the present invention is applicable to high-carbon chromium-nickel heat resistant steels with wide range of compositions containing 0.2 - 1.5% C, 14 - 40% Cr, 10 - 50% Ni, Mn not more than 15%, B not more than 0.01%, and the remainder being essentially iron and impurities. The temperature and time for the formation of "the eutectic $M_7C_3$ structure" vary with the chemical compositions of steels and, therefore, the temperature and time for applying the heat treatment process according to the present invention must be changed in accordance with the steel composition.

Figure 4:
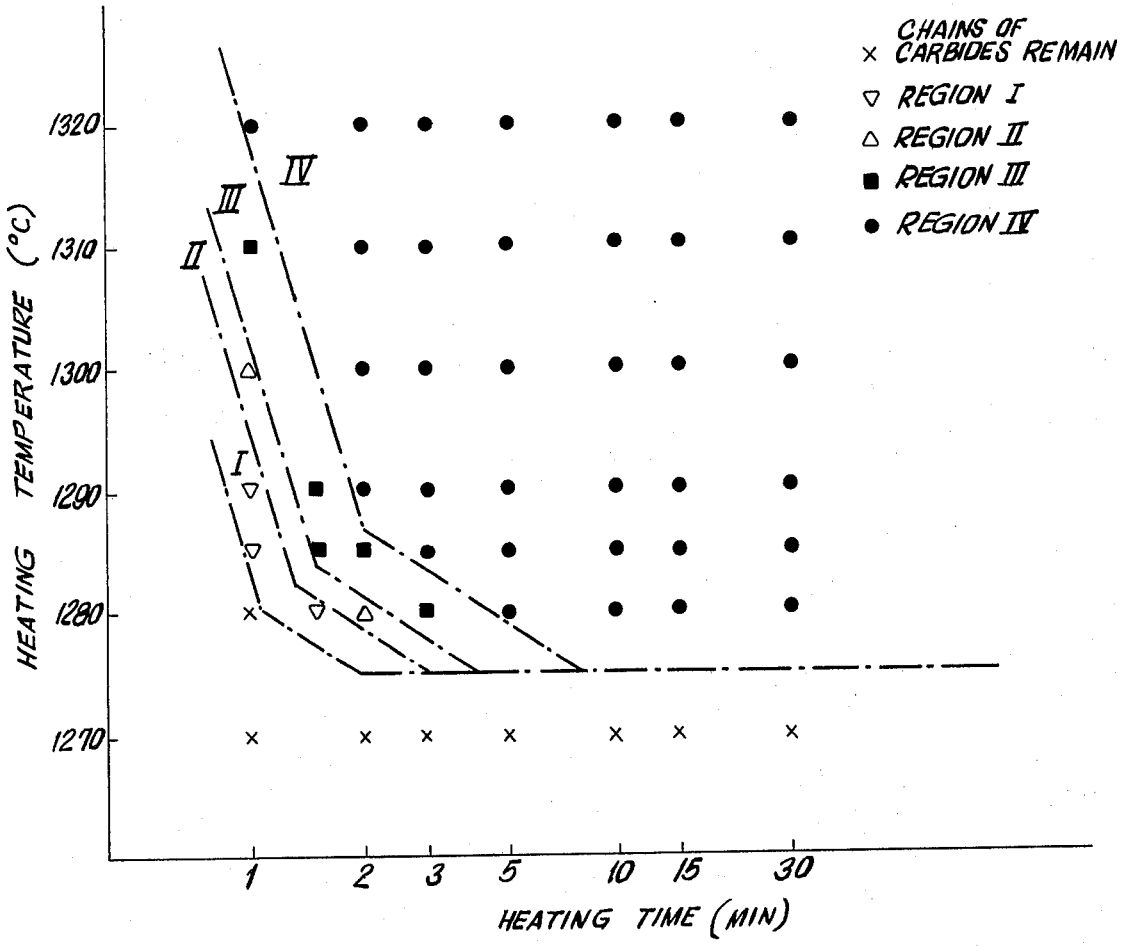
FIG. 4 is a phase diagram indicating the type and the fractions of the carbides which are present in the eutectic carbide structure produced when a high-carbon chromium-nickel heat-resistant stainless steel comprised of 0.4% C, 25% Cr, 20% Ni, 3% Si, 1.5% Mn, and the remainder essentially iron and impurities is heated for 1 and 30 minutes in a temperature range from 1270° to 1320° C.

In the following are demonstrated the practical examples of the present invention. FIG. 4 is a phase diagram representing the types and the fractions of the carbides which are present when a hot-extruded material of a steel containing 0.4% C, 25% Cr, 20% Ni, 3% Si and 1.5% Mn. It is clear from this diagram that the eutectic carbide structure belonging to the region IV is easily obtained in this steel by heating at 1280° C for 5 minutes. In the case of this steel, consequently, the heat treatment process according to the present invention may be applied in the temperature range from 1280° C to the solidus temperature.

In order to obtain improved creep rupture strength in wrought high-carbon chromium-nickel stainless steels by applying the heat treatment process according to the present invention, relatively high rate of cooling after the said heat treatment is important.

Figure 5:
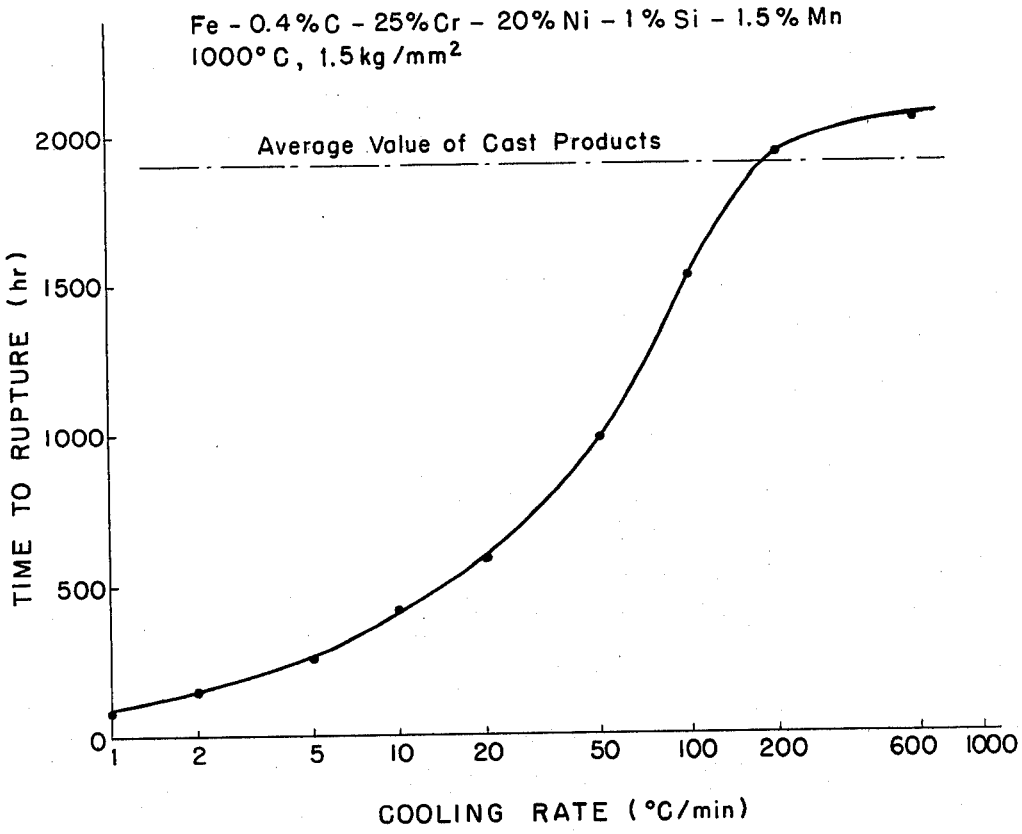
FIG. 5 shows the effect of the cooling rate between 1300° C and 800° C upon the creep rupture life at 1000° C, 1.5 kg/mm$^2$ of a steel containing 0.4% C, 25% Cr, 20% Ni, 1% Si, 1.5% Mn, and the remainder Fe and impurities.

FIG. 5 shows the effect of the cooling rate between 1300° C and 800° C upon the creep rupture life at 1000° C, 1.5 kg/mm$^2$ of a steel containing 0.4% C, 25% Cr, 20% Ni, 1% Si, 1.5% Mn, and the balance being Fe and impurities, which was heat treated for 10 min. at 1340° C. As is evident from this figure, the cooling rate between 1300° C and 800° C should be at least 200° C/min., in order to improve the creep rupture properties of wrough high-carbon chromium-nickel stainless steel to the extent comparable to or superior to the average value of the cast steels with similar chemical composition. On the other hand, when the cooling rate is less than 200° C/min., inferior creep rupture properties are resulted.

The reason is that $M_7C_3$-type carbide is unstable in the temperature range below 1300° C and tends to transform into more stable $M_{23}C_6$-type carbide. Therefore, when the cooling rate is too low, $M_7C_3$-type carbide, which was formed by the heat treatment according to the present invention, partly or completely transforms into massive $M_{23}C_6$-type carbide during cooling, resulting in decrease in the creep rupture strength. In order to prevent such transformation of $M_7C_3$-type carbide into $M_{23}C_6$-type carbide, the cooling rate in the temperature range from 1300° C to 800° C should be at least 100° C/min. Otherwise, the carbide transformation takes place during cooling so that creep rupture strength comparable to or superior to those of centrifugally cast products can not be attained.

The present invention will be more clearly understood from the following examples.

EXAMPLE 1

Table 1 shows the improvement in creep rupture strength at 1000° C when the heat treatment process according to the present invention is applied to the hot-extruded material of a high-carbon chromium-nickel heat resistant stainless steel containing 0.4% C, 25% Cr, 20% Ni, 1% Si and 1.5% Mn.

The rupture life is markedly short in the material as hot-extruded (No. 10) and in the material subjected to the heat treatment at temperatures below 1300 ° C (No. 20), while the rupture life is fairly improved in the material heated for 1 minute at 1300° C (No. 30) and in the material heated for 1 minute at 1310° C (No. 31) (the micro-structures of these two materials belong to the regions I and II, respectively), but it is still inferior to that of the centrifugally cast material (No. 60). In contrast, the material heated at 1330° C for 3 minutes (No. 32), in which the weight fraction of $M_7C_3$-type carbides exceeds 50%, has rupture life comparable to that of centrifugally cast material (No. 60). The materials heated at 1340° C for 1 minute (No. 33) and 10 minutes (No. 34) indicate that the weight fraction of $M_7C_3$-type carbide is 85% and 100%, respectively, and the rupture lives of both materials surpass that of the centrifugally cast material (No. 60).

Table 1

| No. | Heat Treating Condition | Micro-Structure Region | Fraction of Carbide | | Rupture Life* | Remarks |
|---|---|---|---|---|---|---|
| 10 | as hot-extruded | — | — | | 57 hours | Comparative Material |
| 20 | 1290° C, 3 hours W.Q. | — | — | | 62 | Comparative Material |
| 30 | 1300° C, 1 min. W.Q. | I | 100% | $M_{23}C_6$ | 605 | Comparative Material |
| 31 | 1310° C, 1 min. W.Q. | II | 80%<br>20% | $M_{23}C_6$<br>$M_7C_3$ | 1371 | Comparative Material |
| 32 | 1330° C, 3 min. W.Q. | III | 45%<br>55% | $M_{23}C_6$<br>$M_7C_3$ | 1924 | Present Inventive Process |
| 33 | 1340° C, 1 min. W.Q. | III | 15%<br>85% | $M_{23}C_6$<br>$M_7C_3$ | 1987 | Present Inventive Process |
| 34 | 1340° C, 10 min, W.Q. | IV | 100% | $M_7C_3$ | 2068 | Present Inventive Process |

Table 1-continued

| No. | Heat Treating Condition | Micro-Structure Region | Micro-Structure Fraction of Carbide | Rupture Life* | Remarks |
|---|---|---|---|---|---|
| 60 | centrifugally cast material | — | — | 1906 | Comparative Material |

*1000° C, 1.5 kg/mm²

EXAMPLE 2

Table 2 shows the improvement in the creep rupture strength at 1000° C when the heat treatment process according to the present invention is applied to two types of forged high-carbon chromium-nickel heat resistant stainless steels containing 0.4% C, 25% Cr, 20% Ni and 3% Si; and 0.4% C, 25% Cr, 20% Ni, 2% Si and 0.003% B. The material No. 40 containing 3% Si develops the eutectic carbide structure containing 100% of $M_7C_3$-type carbide (a structure belonging to the region IV) by heating for only two minutes at 1300° C, while the steel No. 50 including 2% Si and 0.003% B develops the eutectic carbide structure containing 80% of $M_7C_3$-type carbide (a structure belonging to the region IV) by heating at 1290° C for 5 minutes. Both materials have longer rupture lives than the comparative materials Nos. 10, 20, 30 and the centrifugally cast material No. 60. Thus, it is evident that the creep rupture strength is markedly improved in these materials by applying the heat treatment process according to the present invention.

Table 2

| No. | Chemical Composition C | Si | Mn | Cr | Ni | B | Heat Treatment | Micro-Structure Region | Micro-Structure Fraction of Carbide | Rupture Life* | Remarks |
|---|---|---|---|---|---|---|---|---|---|---|---|
| 10 | 0.4 | 1.0 | 1.5 | 25 | 20 | — | as hot-extruded | — | — | 57 hours | Comparative Material |
| 20 | " | " | " | " | " | — | 1290° C 3 hrs. W.Q. | — | — | 62 | Comparative Material |
| 30 | " | " | " | " | " | — | 1300° C 1 min. W.Q. | I | 100% $M_{23}C_6$ | 605 | Comparative Material |
| 40 | 0.4 | 3.0 | 1.5 | 25 | 20 | — | 1300° C 2 min. W.Q. | IV | 100% $M_7C_3$ | 2890 | Present Inventive Process |
| 50 | 0.4 | 2.0 | 1.5 | 25 | 20 | 0.003 | 1290° C 5 min. W.Q. | III | 80% $M_7C_3$ 20% $M_{23}C_6$ | 2210 | Present Inventive Process |
| 60 | 0.42 | 1.0 | 1.5 | 25 | 20 | — | Centrifugally cast material | — | — | 1906 | Comparative Material |

*1000° C, 1.5 kg/mm²

What is claimed is:

1. A heat treatment process for high-carbon chromium-nickel heat-resistant stainless steels to improve the creep rupture strength in a temperature range over about 800° C particularly at 1000° C, which comprises heating high-carbon chromium-nickel heat-resistant stainless steels consisting essentially of 0.2 – 1.5% C, 15 – 40% Cr, 10 – 50% Ni, Si not more than 5%, Mn not more than 15%, and the remainder being Fe and impurities for 1 to 60 minutes in a temperature range from 1300° C to 1350° C and then quenching the said steel at cooling rates higher than 200° C/min. in order to produce the eutectic carbide structure consisted of the matrix metal and carbide phase in which $M_7C_3$-type carbide is contained not less than 25% by weight of the total weight of carbides, that are present in the said eutectic carbide structure, at grain boundary triple points, along grain boundaries, and within grains.

2. A heat treatment process for high-carbon chromium-nickel heat-resistant stainless steels to improve the creep rupture strength in a temperature range over about 800° C, which comprises heating high-carbon chromium-nickel heat-resistant stainless steels consisting essentially of 0.2 – 1.5% C, 15 – 40% Cr, 10 – 50% Ni, Si not more than 5%, Mn not more than 15%, further containing B not more than 0.01%, and the remainder being Fe and impurities for 1 to 60 minutes in a temperature range from 1280° C to 1320° C and then quenching the said steel at cooling rates higher than 200° C/min. in order to produce the eutectic carbide structure consisted of the matrix metal and carbide phases in which $M_7C_3$-type carbide is contained not less than 25% by weight of the total weight of carbides that are present in the said eutectic carbide structure, at grain boundary triple points, along grain boundaries, and within grains.

* * * * *